US007398895B2

(12) United States Patent
Kim

(10) Patent No.: US 7,398,895 B2
(45) Date of Patent: Jul. 15, 2008

(54) PHARMACEUTICAL TABLET DISPENSING AND PACKAGING SYSTEM

(76) Inventor: Jun Ho Kim, 100-23, Galsandong, Dalsuhgu, Taegu (KR)

( * ) Notice: Subject to any disclaimer, the term of this patent is extended or adjusted under 35 U.S.C. 154(b) by 534 days.

(21) Appl. No.: 10/804,603

(22) Filed: Mar. 18, 2004

(65) Prior Publication Data

US 2004/0182878 A1 Sep. 23, 2004

(30) Foreign Application Priority Data

Mar. 19, 2003 (KR) ..... 10-2003-0017155

(51) Int. Cl.
*A47F 1/04* (2006.01)

(52) U.S. Cl. ..... 221/154; 221/92; 221/131; 221/124; 221/264; 221/179

(58) Field of Classification Search ..... 221/154, 221/92, 131, 124, 264, 179
See application file for complete search history.

(56) References Cited

U.S. PATENT DOCUMENTS 4,267,942 A * 5/1981 Wick et al. ..... 221/2
5,337,919 A * 8/1994 Spaulding et al. ..... 221/2
5,348,061 A * 9/1994 Riley et al. ..... 141/104
5,611,456 A * 3/1997 Kasper ..... 221/154
5,709,063 A * 1/1998 Yuyama et al. ..... 53/154
5,787,678 A * 8/1998 Koike et al. ..... 53/154
6,012,602 A * 1/2000 Yuyama et al. ..... 221/130
6,308,494 B1 * 10/2001 Yuyama et al. ..... 53/131.3
6,349,848 B1 * 2/2002 Uema et al. ..... 221/6
6,367,232 B2 4/2002 Kim
6,449,921 B1 9/2002 Kim
6,585,132 B2 7/2003 Kim
6,644,504 B2 * 11/2003 Yuyama et al. ..... 221/265
6,792,736 B1 * 9/2004 Takahashi et al. ..... 53/237
6,805,259 B2 * 10/2004 Stevens et al. ..... 221/124

* cited by examiner

*Primary Examiner*—Patrick Mackey
*Assistant Examiner*—Michael E. Butler
(74) *Attorney, Agent, or Firm*—John K. Park; Park Law Firm

(57) ABSTRACT

A pharmaceutical tablet dispensing and packaging system comprising a tablet packaging unit and a tablet dispensing unit having door cabinets and a base cabinet with each door cabinet rear portion detachably engaged to the base cabinet rear portion. Each cabinet rear portion is vertically wrinkled to form ridges and furrows so that when the door cabinets are attached to the base cabinet, spatial shafts are formed by the furrows and ridges.

31 Claims, 8 Drawing Sheets

PHARMACEUTICAL TABLET DISPENSING AND PACKAGING SYSTEM

CLAIMING FOREIGN PRIORITY

The applicant claims and requests a foreign priority, through the Paris Convention for the Protection of Industry Property, based on a patent application filed in the Republic of Korea (South Korea) with the filing date of Mar. 19, 2003, with the application number 10-2003-0017155, by the applicant. (see the attached declaration)

BACKGROUND OF THE INVENTION

The invention relates to a pharmaceutical automation system. More particularly, the present invention relates to a pharmaceutical tablet dispensing and packaging system which facilitates cleaning and maintenance of tablet passage channels through which tablets are released for tablet packaging.

In order to increase capacity for housing the tablet cassettes, a flat type cabinet or a cylindrical type cabinet have been widely adopted to stack therein as many tablet cassettes as the system allows. Each tablet in the tablet cassettes comes to fall through a tablet channel into a tablet packaging portion. So each tablet channel inevitably holds on its wall either dusts or debris out of the dropping tablets. A tiny amount of tablet debris may result in medical care for a patient taking tablets packaged through the conventional tablet dispensing and packaging system. FIG. 9 shows a conventional swingable tablet cassette cabinet 2 that results in difficulty cleaning tablet channels 4 between tablet cassettes 6 for tablets to fall from the cassettes.

As shown in FIGS. 8 and 9, Korean Utility Model No. 0297047 discloses a main body 100, cassettes 102, a base cabinet 104, tablet channels 106, tablet packaging unit 108*a*, front door cabinet 110*a*, rear door cabinet 110*b*, and vertical plate 114. Tablets are released through the channels 106 formed by the waved vertical plates 114 of the cabinets 110*a*, 110*b*. The front and rear door cabinets 110*a*, 110*b* are selectively opened to clean tablet debris from the channels 106. However, the '047 does not allow total cleaning since the cabinets are formed in an undetachable format, disadvantageously requiring significant amount of time in cleaning the channels because the cabinets need to be detached from the system.

SUMMARY OF THE INVENTION

The present invention is contrived to overcome the conventional disadvantages. Accordingly, an object of the present invention to provide a pharmaceutical tablet dispensing and packaging system that facilitates cleaning of tablet channels with efficiency. Another object of the present invention is to substantially increase product reliability by minimizing possibility that unwanted dusts or debris from other sources may be contained in a prescription tablet bag. A further object of the present invention is to substantially increase capacity of housing tablet cassettes in the system while facilitating management efficiency in a multi-cabinet system.

To achieve these and other objects, a pharmaceutical tablet dispensing and packaging system according to the present invention comprises a tablet packaging unit and a tablet dispensing unit having two or more door cabinets and a base cabinet each defined by a front portion and a rear portion. Each door cabinet rear portion is detachably engaged to the base cabinet rear portion and the rear portion of each cabinet is vertically wrinkled to form ridges and furrows. So when the door cabinets are attached to the base cabinet a plurality of spatial shafts are formed by the furrows and ridges of the cabinet rear portions. Tablet cassettes each containing tablets are installed in each cabinet to selectively release the tablets through the spatial shafts down to the tablet packaging unit disposed below the tablet dispensing unit, whereby the spatial shafts serving as downward channels allow the released tablets to fall toward the tablet packaging unit.

A hopper is disposed beneath the dispensing unit into the tablet packaging unit to guide the released tablets down into the tablet packaging unit for tablet packaging. The spatial shafts are substantially rectangular when viewed atop, and each door cabinet is hingedly connected to the base cabinet. A plurality of tablet dispensing units each having two or more door cabinets and at least one tablet-dispensing front unit resembling one of the tablet dispensing rear units in construction and disposed on top of the tablet packaging unit. The front unit is substantially perpendicular to the rear units.

A plurality of tablet dispensing rear units horizontally aligned longer-side by longer-side and the rear units are linearly slidable to move back and forth so that the forward sliding (toward the front unit) of the rear units can be effected when the front unit is open, whereby the rear units are selectively pulled out through a space reserved by opening the front unit.

In this construction, there are further provided a printer to print respective information on a packaging paper, and a heater assembly to package the tablets released through the hopper into one or more partitioned paper bags using the packaging paper. A plurality of hampers may be formed through the door cabinets and corresponding portions of the base cabinet to soften opening and closing of the respective door cabinets from and to the base cabinet. A first locking member is provided to include hooks and hookers where the hooks are each formed on a door cabinet frame of said each door cabinet, and the hookers are formed on a base cabinet frame corresponding to the door cabinet frames.

A second locking member is further provided to include male bolts and female bolts releasably receiving therein the male bolts, and each male bolt is fixedly formed though said each ridge of the base cabinet rear portion. Each female bolt is releasably formed in the base cabinet and covered by the corresponding ridge of said each door cabinet rear portion to receive therein the corresponding male bolt through the ridge of the base cabinet rear portion, whereby the opening and closing of the door cabinets from and to the base cabinet are easily controlled by a simple turn of the female bolt. The ridges are preferably flat and wider than the furrows. A stopper may be formed on said each female bolt to prevent an unwanted release of said each female bolt from the base cabinet.

First advantage of the present invention is that the dividable construction of the tablet channels enables a pharmacist or system operator to easily clean the tablet channels by simply detaching or opening the door cabinets from the base cabinet with ease, thereby improving product reliability. Second, the paired tablet dispensing cabinets establish a visual noticeability as to when to clean the tablet channels, thus improving system management efficiency. Third, the paired tablet dispensing cabinets enable a fast trek cleaning of the tablet channels, compared to the conventional tablet cabinet system, using a known vacuum cleaning tool, thereby enhancing customer satisfaction.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION OF THE PREFERRED EMBODIMENTS

Figure 1:
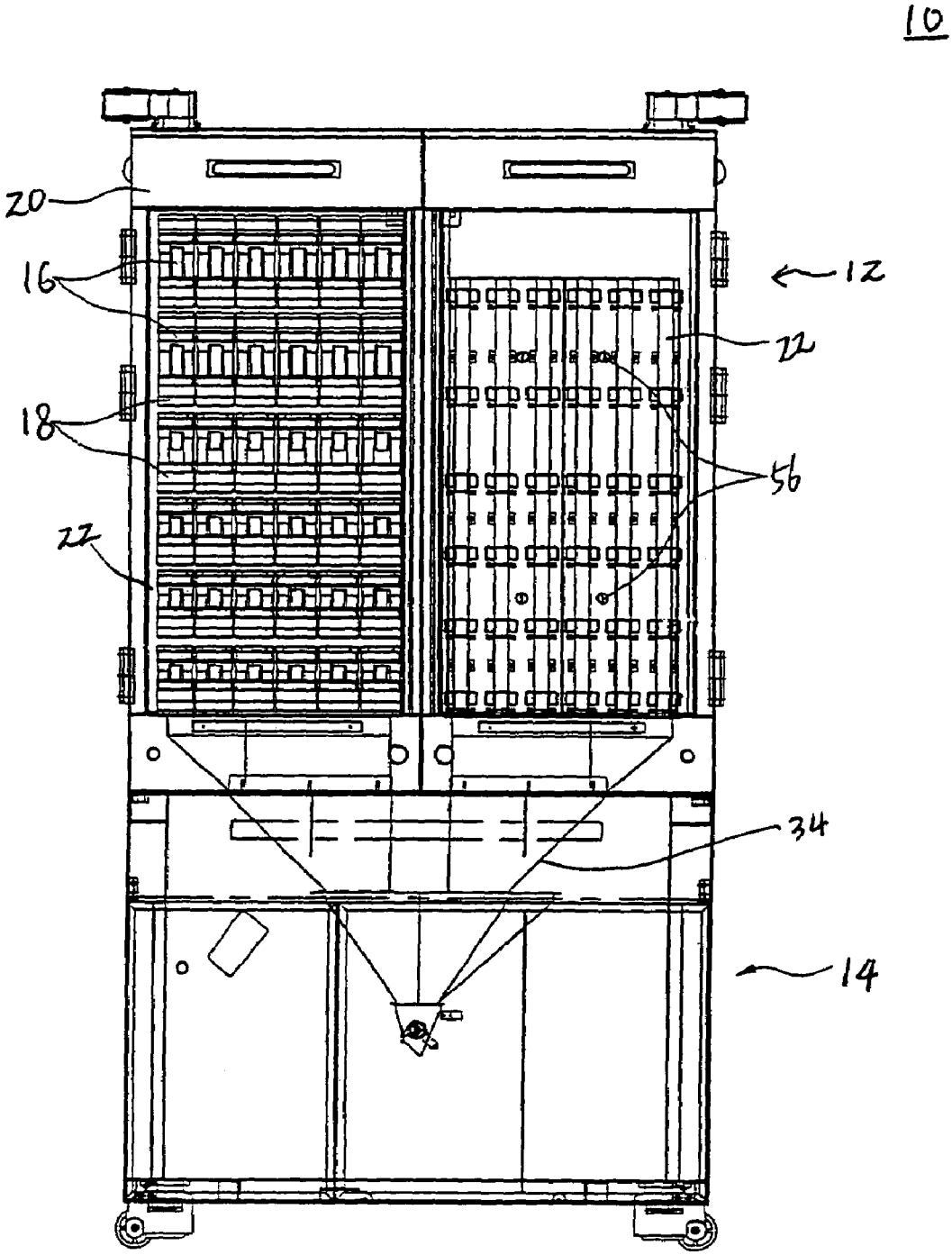
FIG. 1 is a front view of a pharmaceutical tablet dispensing and packaging system according to the present invention.

As shown in FIGS. 1-5, a pharmaceutical tablet dispensing and packaging system 10 according to the present invention comprises a tablet dispending unit 12 and a tablet packaging unit 14. A plurality of tablet cassettes 16 are detachably mounted on cartridges 18 installed in the tablet dispending unit 12. A frame 20 incorporates the dispensing unit 12 to house the cartridges 18 and the tablet cassettes 16.

Figure 6:
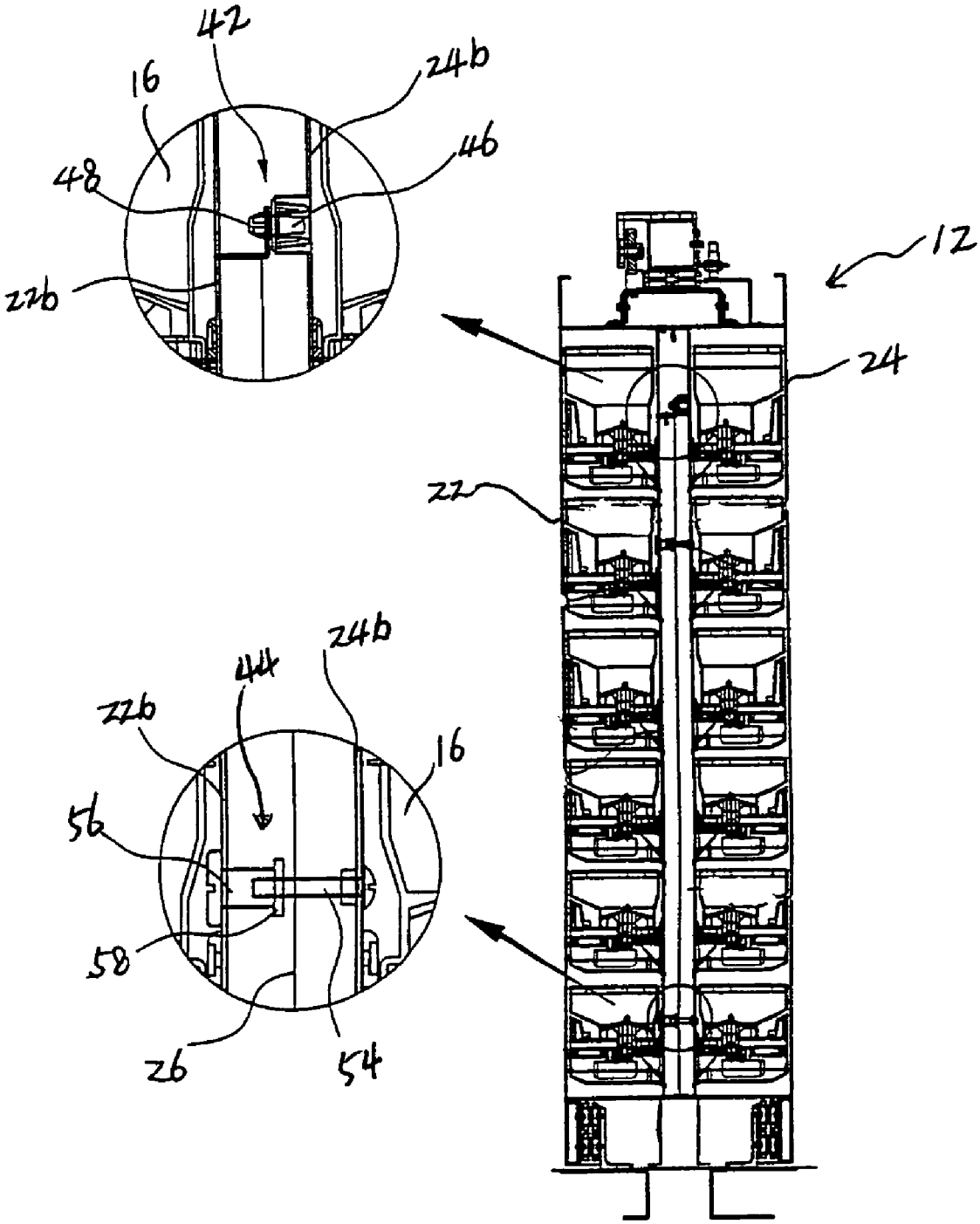
FIG. 6 is a view showing an engagement mechanism of cabinets according to the present invention.
Figure 7:
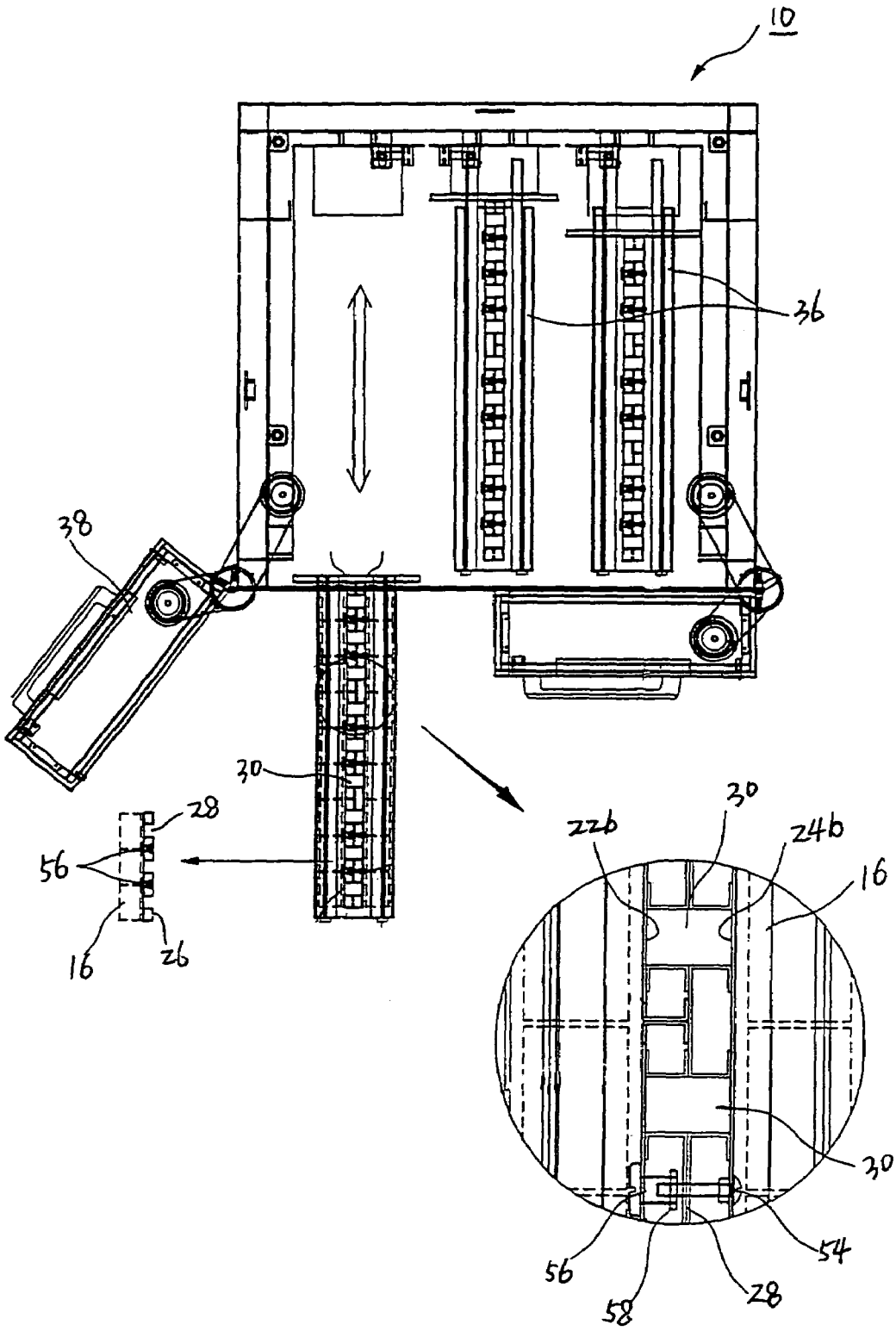
FIG. 7 is a view showing a sliding mechanism according to the present invention.
Figure 8:
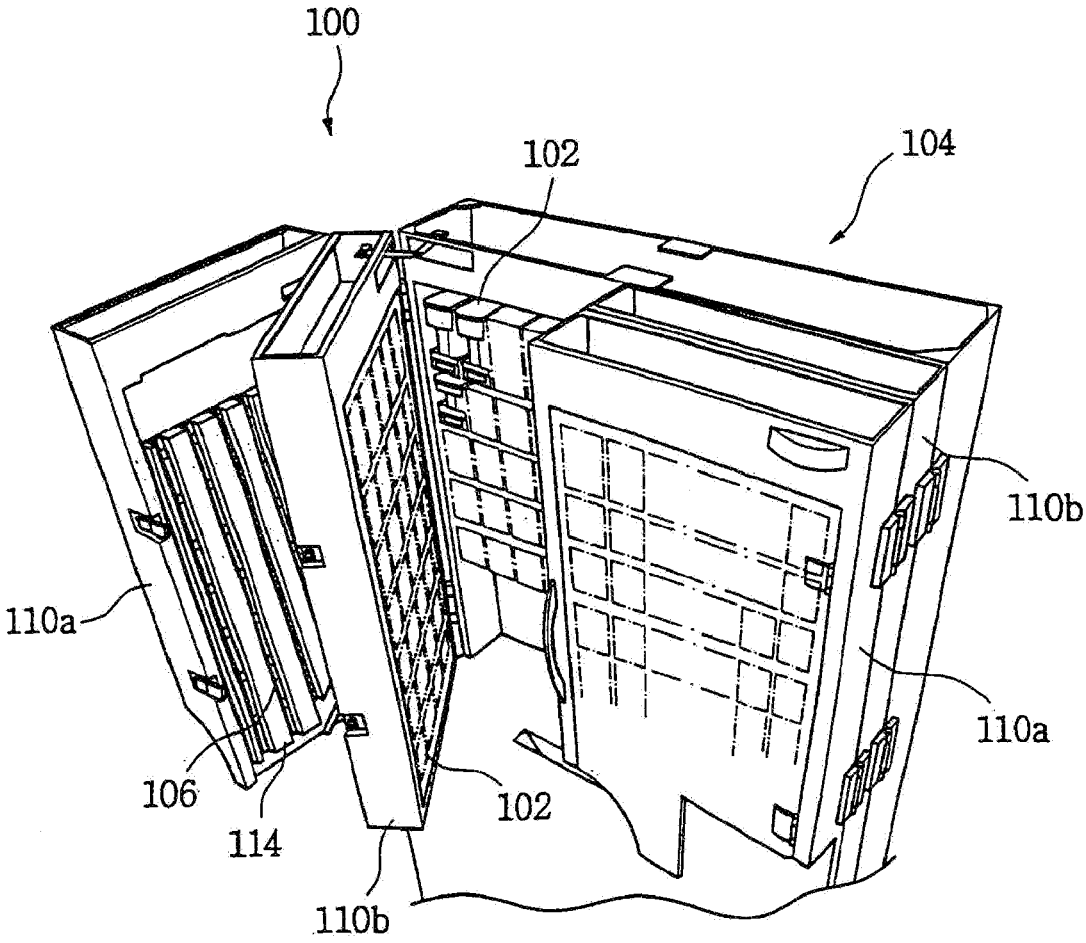
Fig. 8 Prior Art
FIGS. 8 and 9 are views each showing a prior art.
Figure 9:
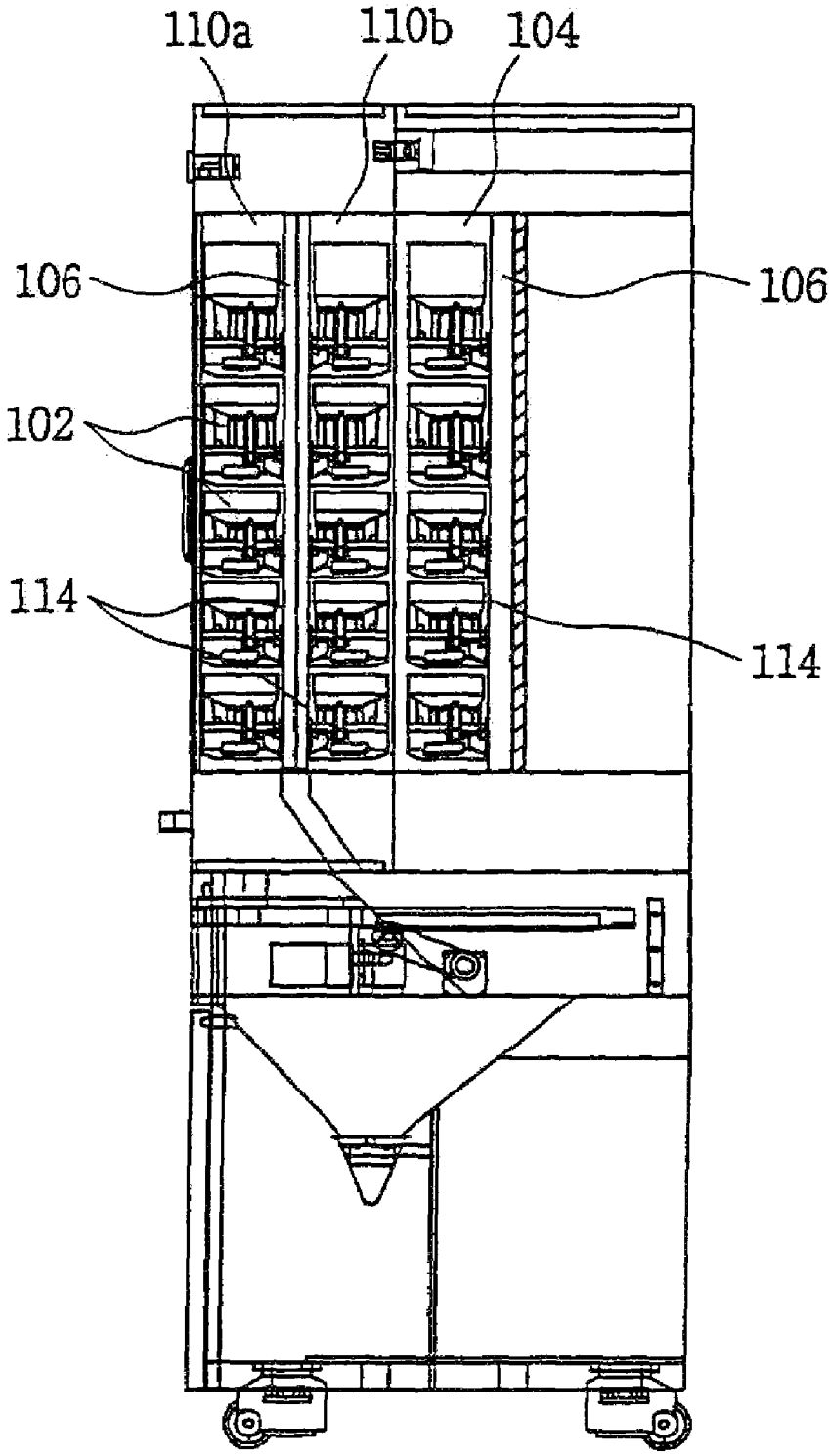
Fig. 9 Prior Art

The tablet dispensing unit 12 is provided with two or more door cabinets 22 and a base cabinet 24 each defined by a front portion 22*a*, 24*a* and a rear portion 22*b*, 24*b*. Each door cabinet rear portion 22*b* is detachably engaged to the base cabinet rear portion 24*b*. The rear portions 22*b*, 24*b* of the front and base cabinets 22, 23, 24 is vertically wrinkled to form ridges 26 and furrows 28. In this construction, when the door cabinets 22 are attached to the base cabinet 24, a plurality of spatial shafts 30 as shown in FIGS. 6 and 7 are formed by the furrows 28 and ridges 26 of the cabinet rear portions 22*b*, 24*b*. That is, the detachable abutment of the door cabinet rear portion 22*b* to the base cabinet rear portion 24*b* enables subsequent abutments of the ridges 26 of each rear portion 22*b*, 24*b* to simultaneously make the furrows 28 turn to the spatial shafts 30. The door cabinets 22 may be either detachably attached to the base cabinet 24 or hingedly connected to the base cabinet 24.

Tablet cassettes 16 each containing tablets 32 are installed in each cabinet 22, 23, 24 and selectively release the tablets 32 through the spatial shafts 30 down to the tablet packaging unit 14 disposed below the tablet dispensing unit 12. Specifically, the tablets 32 stored in each tablet cassette 16 is selectively released under control of the controller (not shown) via a release hole 33 into the corresponding shaft 30. The release hole 33 is formed through the furrows 28 of each cabinet rear portion 22*b*, 24*b*. Accordingly, the spatial shafts 30 serving as downward channels allow the released tablets 32 to fall subsequently through the release hole 33 and the corresponding shaft 30 toward the tablet packaging unit 14. Preferably, the spatial shafts 30 are substantially rectangular when viewed atop. In a preferred version, the spatial shafts 30 may be shaped either circular or oval.

For a better performance, further provided is a hopper 34 disposed beneath the dispensing unit 12 into the tablet packaging unit 14 to guide the released tablets 32 down into the tablet packaging unit 17 for tablet packaging.

As further shown in FIG. 7, a plurality of tablet dispensing rear units 36 are provided to respectively have two or more door cabinets 22 and a base cabinet 24 to which rear surface 24*a* the door cabinet rear surface 22*b* is detachably attached.

In a preferred version, at least one tablet-dispensing front unit 38 that resembles one of the tablet dispensing rear units 36 in construction is disposed on top of the tablet packaging unit 14. Here, it is preferred that the front unit 38 is substantially perpendicular to the rear units 36. The plurality of tablet dispensing rear units 36 are horizontally aligned longer-side by longer-side to realize a slidable format. Specifically, the rear units 36 are linearly slidable to move back and forth so that the forward sliding (toward the front unit 38) of the rear units 36 can be effected when the front unit 38 is open, whereby the rear units 36 are selectively pulled out through a space reserved by opening the front unit 38.

The tablet packaging unit 14 may comprise a printer (not shown) a heater assembly (not shown). The printer is provided to print respective information on a packaging paper (not shown), and the heater assembly is provided to package the tablets 32 released through the hopper 34 into one or more partitioned paper bags (not shown) using the packaging paper (not shown).

Selectively, a plurality of hampers 40 are formed through the door cabinets 22 and corresponding portions of the base cabinet 24 to soften opening and closing of the respective door cabinets 22 from and to the base cabinet 24. Further, first and locking members 42, 44 are selectively provided to control the locking mechanism of the door cabinets 22 to the base cabinet 24. The first locking member 42 has hooks 48 and hookers 46. The hooks 48 are each formed on a door cabinet frame 50 of each door cabinet 22. The hookers 46 are formed on a base cabinet frame 52 corresponding to the door cabinet frames 50.

Meanwhile, the second locking member 44 having male bolts 54 and female bolts 56 releasably receiving therein the male bolts 54. Each male bolt 54 is fixedly formed though each ridge 26 of the base cabinet rear portion 24*b*. Each female bolt 56 is releasably formed in the door cabinet and covered by the corresponding ridge 26 of each door cabinet rear portion 22*b* so as to receive therein the corresponding male bolt 54 through the ridge 26 of the door cabinet rear portion 22*b*. In this construction, the opening and closing of the door cabinets 22 from and to the base cabinet 24 are easily controlled by a simple turn of the female bolt 56. Preferably, the ridges 26 are flat and wider than the furrows 28.

Figure 2:
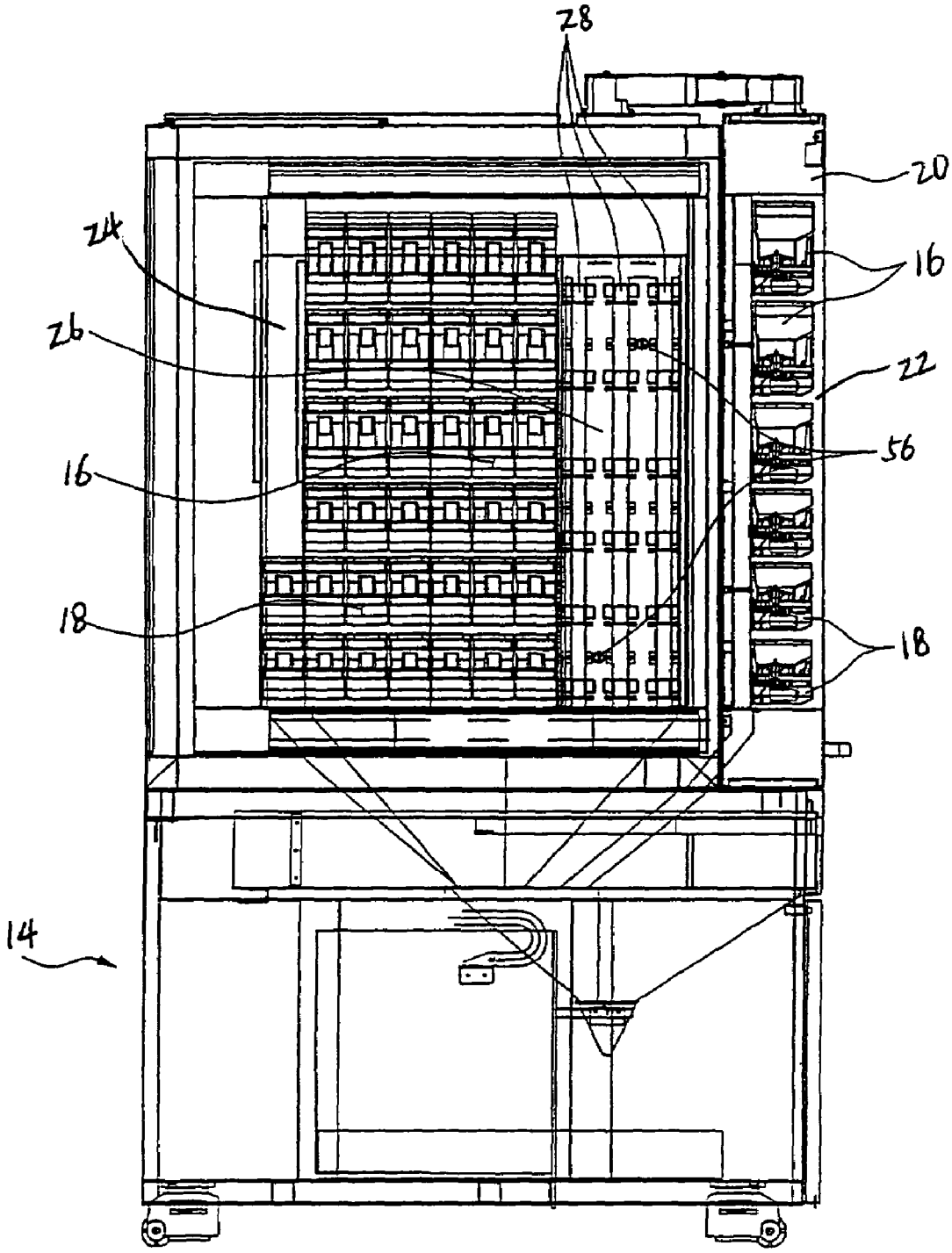
FIG. 2 is a side view of FIG. 1.
Figure 3:
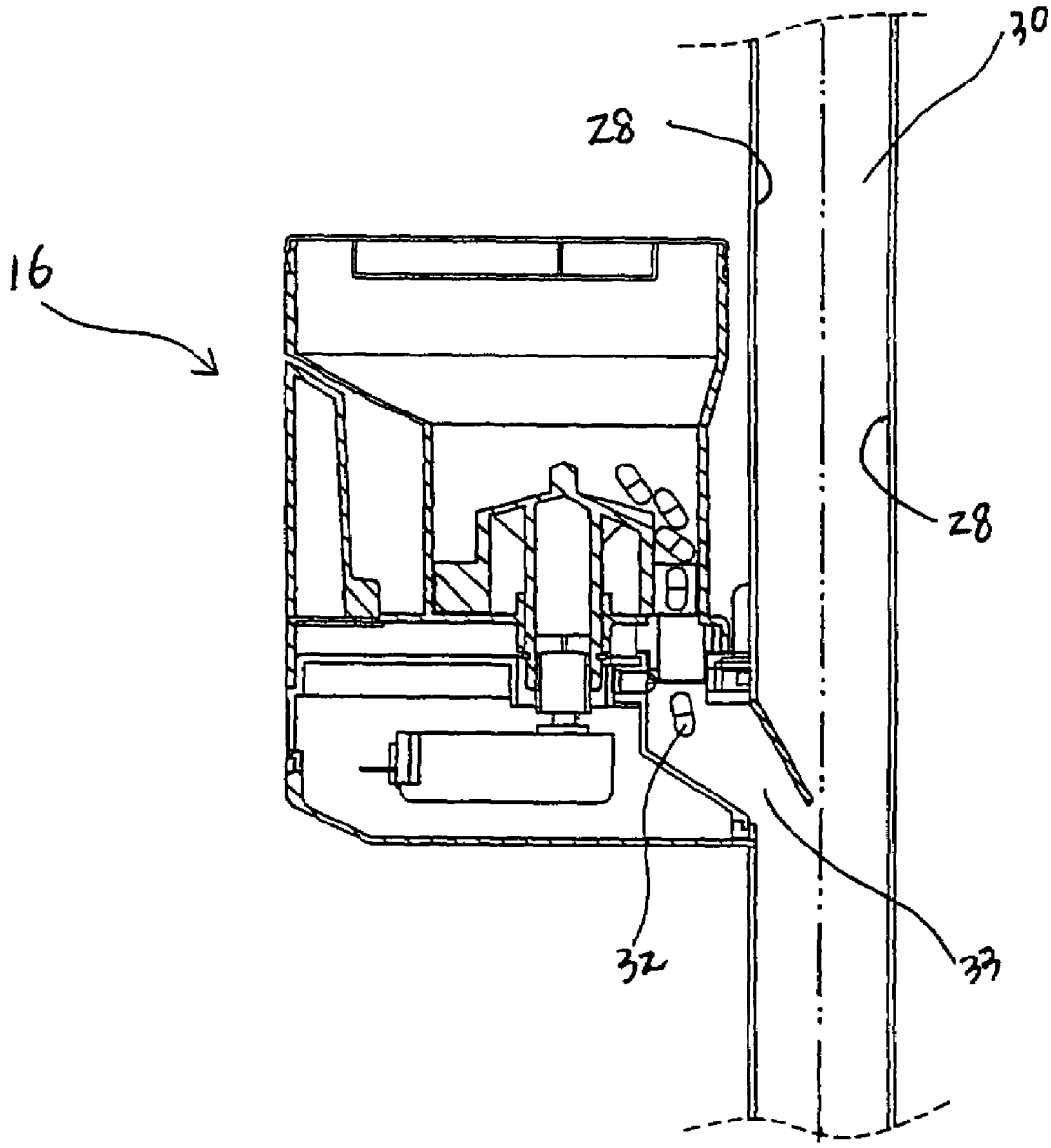
FIG. 3 is a view showing a tablet release mechanism according to the present invention.
Figure 4:
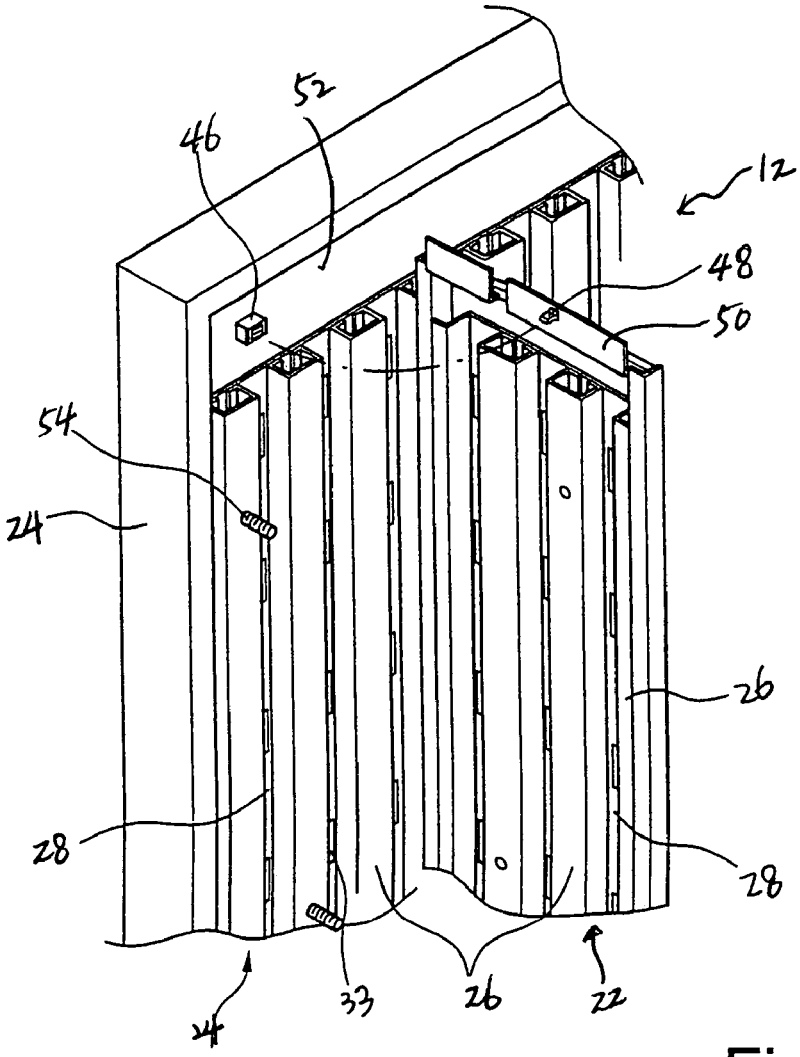
FIG. 4 is a view showing a cabinet opening mechanism according to the present invention.
Figure 5:
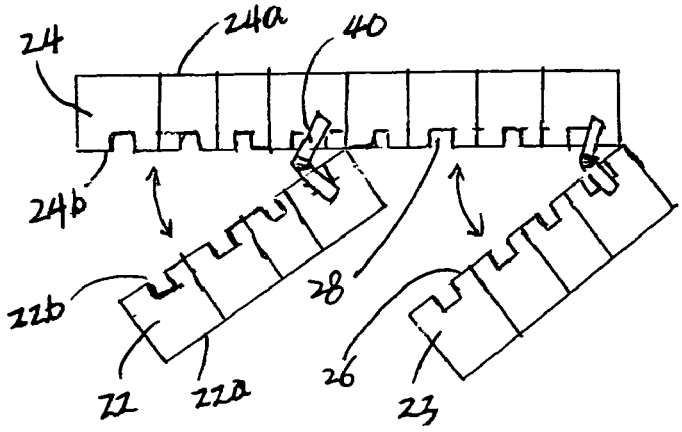
FIG. 5 is a schematic plan view showing the cabinet opening mechanism in FIG. 4.

As shown back in FIGS. 1 and 2 where tablet cassettes 16 are partially removed from each door cabinet 22, 23, the female bolt 56 is simply loosened to detach the door cabinet 22, 23 from the base cabinet 24 to perform cleaning of the respective furrows 28 that may contain dust and debris from the repeated tablet passage through the spatial shafts 30. Since the tablets 32 are usually taken by patients following medical doctor's prescription, the periodic cleaning of the spatial shafts 30 are significant issue and dealt with under strict internal regulations in most drugstores.

For a better performance, a stopper 58 may be formed on each female bolt 56 to prevent an unwanted release of each female bolt 56 from the base cabinet 22. So when releasing the door cabinet 22 from the base cabinet 24 by loosening the female bolt 56 the female bolt 56 can stay within the door cabinet 22 to thereby facilitate hooking up the detached door cabinet 22 on the base cabinet 24 or unhooking the attached door cabinet 22 from the base cabinet 24 for cleaning of the spatial shafts 30.

As discussed above, an advantage of the present invention is that the dividable construction of the tablet channels 30 enables a pharmacist or system operator to easily clean the tablet channels 30 by simply detaching or opening the door cabinets 22 from the base cabinet 24 with ease, thereby improving product reliability. In addition, the paired tablet dispensing cabinets 22, 23, 24 establish a visual noticeability as to when to clean the tablet channels 30, thus improving system management efficiency. Further, the paired tablet dispensing cabinets 22, 23, 24 enable a fast trek cleaning of the tablet channels 30, compared to the conventional tablet cabinet system, using a known vacuum cleaning tool, thereby enhancing customer satisfaction.

Although the invention has been described in considerable detail with reference to certain preferred versions thereof, other versions are possible by converting the aforementioned construction. Therefore, the scope of the invention shall not be limited by the specification specified above and the appended claims.

What is claimed is:

1. A pharmaceutical tablet dispensing and packaging system, comprising:

a) a tablet packaging unit;

b) a tablet dispensing unit having two or more door cabinets and a base cabinet each defined by a front portion and a rear portion, wherein said each door cabinet rear portion is detachably engaged to the base cabinet rear portion, wherein the rear portion of said each cabinet is vertically wrinkled to form ridges and furrows so that when the door cabinets are attached to the base cabinet a plurality of spatial shafts are formed by the furrows and ridges of the cabinet rear portions, wherein each of the spatial shafts is formed by two opposing furrows and two adjacent spatial shafts are divided by two opposing ridges, wherein tablet cassettes each containing tablets are installed in said each cabinet to selectively release the tablets through the spatial shafts down to the tablet packaging unit disposed below the tablet dispensing unit, whereby the spatial shafts serving as downward channels allow the released tablets to fall toward the tablet packaging unit; and c) a hopper disposed beneath the dispensing unit into the tablet packaging unit to guide the released tablets down into the tablet packaging unit for tablet packaging.

2. The system of claim 1 wherein said each door cabinet is hingedly connected to the base cabinet.

3. The system of claim 1 further comprising a plurality of hampers formed through the door cabinets and corresponding portions of the base cabinet to soften opening and closing of the respective door cabinets from and to the base cabinet.

4. The system of claim 1 further comprising a first locking member having hooks and hookers, wherein the hooks are each formed on a door cabinet frame of said each door cabinet, wherein the hookers are formed on a base cabinet frame corresponding to the door cabinet frames.

5. The system of claim 1 further comprising a second locking member having male bolts and female bolts releasably receiving therein the male bolts, wherein said each male bolt is fixedly formed though said each ridge of the base cabinet rear portion, wherein said each female bolt is releasably formed in the door cabinet and covered by the corresponding ridge of said each door cabinet rear portion to receive therein the corresponding male bolt through the ridge of the door cabinet rear portion, whereby the opening and closing of the door cabinets from and to the base cabinet are easily controlled by a simple turn of the female bolt.

6. The system of claim 5 wherein a stopper is formed on said each female bolt to prevent an unwanted release of said each female bolt from the base cabinet.

7. The system of claim 1 further comprising:

a) a first locking member having hooks and hookers, wherein the hooks are each formed on a door cabinet frame of said each door cabinet, wherein the hookers are formed on a base cabinet frame corresponding to the door cabinet frames; and b) a second locking member having male bolts and female bolts releasably receiving therein the male bolts, wherein said each male bolt is fixedly formed though said each ridge of the base cabinet rear portion, wherein said each female bolt is releasably formed in the door cabinet and covered by the corresponding ridge of said each door cabinet rear portion to receive therein the corresponding male bolt through the ridge of the door cabinet rear portion, whereby the opening and closing of the door cabinets from and to the base cabinet are easily controlled by a simple turn of the female bolt.

8. The system of claim 7 wherein a stopper is formed on said each female bolt to prevent an unwanted release of said each female bolt from the base cabinet.

9. The system of claim 1 wherein the ridges are flat and wider than the furrows.

10. The system of claim 1 wherein the spatial shafts are substantially rectangular when viewed atop.

11. A pharmaceutical tablet dispensing and packaging system, comprising:

a) a tablet packaging unit;

b) a plurality of tablet dispensing units each having two or more door cabinets and a base cabinet each defined by a front portion and a rear portion, wherein said each door cabinet rear portion is detachably engaged to the base cabinet rear portion, wherein the rear portion of said each cabinet is vertically wrinkled to form ridges and furrows so that when the door cabinets are attached to the corresponding base cabinet a plurality of spatial shafts are formed by the furrows and ridges of the cabinet rear portions, wherein each of the spatial shafts is formed by two opposing furrows and two adjacent spatial shafts are divided by two opposing ridges, wherein tablet cassettes each containing tablets are installed in said each cabinet to selectively release the tablets through the spatial shafts down to the tablet packaging unit disposed below the tablet dispensing units, whereby the spatial shafts serving as downward channels allow the released tablets to fall toward the tablet packaging unit; and c) a hopper disposed beneath the dispensing units into the tablet packaging unit to guide the released tablets down into the tablet packaging unit for tablet packaging.

12. The system of claim 11 wherein said each door cabinet is hingedly connected to the corresponding base cabinet.

13. The system of claim 11 further comprising a plurality of hampers formed through the door cabinets and corresponding portions of the base cabinet to soften opening and closing of the respective door cabinets from and to the base cabinet.

14. The system of claim 11 further comprising a first locking member having hooks and hookers, wherein the hooks are each formed on a door cabinet frame of said each door cabinet, wherein the hookers are formed on a base cabinet frame corresponding to the door cabinet frames.

15. The system of claim 11 further comprising a second locking member having male bolts and female bolts releasably receiving the male bolts, wherein said each male bolt is fixedly formed though said each ridge of the base cabinet rear portion, wherein said each female bolt is releasably formed in the door cabinet and covered by the corresponding ridge of said each door cabinet rear portion to receive therein the corresponding male bolt through the ridge of the door cabinet rear portion, whereby the opening and closing of the door cabinets from and to the base cabinet are easily controlled by a simple turn of the female bolt.

16. The system of claim 15 wherein a stopper is formed on said each female bolt to prevent an unwanted release of said each female bolt from the base cabinet.

17. The system of claim 11 further comprising:

a) a first locking member having hooks and hookers, wherein the hooks are each formed on a door cabinet frame of said each door cabinet, wherein the hookers are formed on a base cabinet frame corresponding to the door cabinet frames; and b) a second locking member having male bolts and female bolts releasably receiving the male bolts, wherein said each male bolt is fixedly formed though said each ridge of the base cabinet rear portion, wherein said each female bolt is releasably formed in the door cabinet and covered by the corresponding ridge of said each door cabinet rear portion to receive therein the corresponding male bolt through the ridge of the base cabinet rear portion, whereby the opening and closing of the door cabinets from and to the base cabinet are easily controlled by a simple turn of the female bolt.

18. The system of claim 17 wherein a stopper is formed on said each female bolt to prevent an unwanted release of said each female bolt from the base cabinet.

19. The system of claim 11 wherein the ridges are flat and wider than the furrows.

20. The system of claim 11 wherein the spatial shafts are substantially rectangular when viewed atop.

21. A pharmaceutical tablet dispensing and packaging system, comprising:

a) a tablet packaging unit;

b) a plurality of tablet dispensing rear units horizontally aligned longerside by longer-side and each having two or more door cabinets and a base cabinet each defined by a front portion and a rear portion, wherein said each door cabinet rear portion is detachably engaged to the base cabinet rear portion, wherein the rear portion of said each cabinet is vertically wrinkled to form ridges and furrows so that when the door cabinets are attached to the corresponding base cabinet a plurality of spatial shafts are formed by the furrows and ridges of the cabinet rear portions, wherein each of the spatial shafts is formed by two opposing furrows and two adjacent spatial shafts are divided by two opposing ridges, wherein tablet cassettes each containing tablets are installed in said each cabinet to selectively release the tablets through the spatial shafts down to the tablet packaging unit disposed below the tablet dispensing rear units, whereby the spatial shafts serving as downward channels allow the released tablets to fall toward the tablet packaging unit;

c) at least one tabletdispensing front unit resembling one of the tablet dispensing rear units in construction and disposed on top of the tablet packaging unit, wherein the front unit is substantially perpendicular to the rear units; and d) a hopper disposed beneath the dispensing units into the tablet packaging unit to guide the released tablets down into the tablet packaging unit for tablet packaging.

22. The system of claim 21 wherein the rear units are linearly slidable to move back and forth so that the forward sliding (toward the front unit) of the rear units can be effected when the front unit is open, whereby the rear units are selectively pulled out through a space reserved by opening the front unit.

23. The system of claim 21 wherein said each door cabinet is hingedly connected to the corresponding base cabinet.

24. The system of claim 21 further comprising a plurality of hampers formed through the door cabinets and corresponding portions of the base cabinet to soften opening and closing of the respective door cabinets from and to the base cabinet.

25. The system of claim 21 further comprising a first locking member having hooks and hookers, wherein the hooks are each formed on a door cabinet frame of said each door cabinet, wherein the hookers are formed on a base cabinet frame corresponding to the door cabinet frames.

26. The system of claim 21 further comprising a second locking member having male bolts and female bolts releasably receiving the male bolts, wherein said each male bolt is fixedly formed though said each ridge of the base cabinet rear portion, wherein said each female bolt is releasably formed in the door cabinet and covered by the corresponding ridge of said each door cabinet rear portion to receive therein the corresponding male bolt through the ridge of the door cabinet rear portion, whereby the opening and closing of the door cabinets from and to the base cabinet are easily controlled by a simple turn of the female bolt.

27. The system of claim 26 wherein a stopper is formed on said each female bolt to prevent an unwanted release of said each female bolt from the base cabinet.

28. The system of claim 21 further comprising:

a) a first locking member having hooks and hookers, wherein the hooks are each formed on a door cabinet frame of said each door cabinet, wherein the hookers are formed on a base cabinet frame corresponding to the door cabinet frames; and b) a second locking member having male bolts and female bolts releasably receiving the male bolts, wherein said each male bolt is fixedly formed though said each ridge of the base cabinet rear portion, wherein said each female bolt is releasably formed in the door cabinet and covered by the corresponding ridge of said each door cabinet rear portion to receive therein the corresponding male bolt through the ridge of the door cabinet rear portion, whereby the opening and closing of the door cabinets from and to the base cabinet are easily controlled by a simple turn of the female bolt.

29. The system of claim 28 wherein a stopper is formed on said each female bolt to prevent an unwanted release of said each female bolt from the base cabinet.

30. The system of claim 21 wherein the ridges are flat and wider than the furrows.

31. The system of claim 21 wherein the spatial shafts are substantially rectangular when viewed atop.

* * * * *